United States Patent [19]

Skinner

[11] 4,116,362

[45] Sep. 26, 1978

[54] LID LIFTING TOOL FOR SHIPPING CONTAINERS

[76] Inventor: Warren Skinner, 520 Delphi, Sheridan, Wyo. 82801

[21] Appl. No.: 821,704

[22] Filed: Aug. 4, 1977

[51] Int. Cl.[2] ..... B65D 43/26

[52] U.S. Cl. ..... 220/284; 81/3.46 R

[58] Field of Search ..... 220/284, 285; 81/3.46

[56] References Cited

U.S. PATENT DOCUMENTS

| | | | |
|---|---|---|---|
| 2,675,721 | 4/1954 | Kramer et al. | 81/3.46 |
| 3,290,967 | 12/1966 | Stark | 81/3.46 |
| 3,811,597 | 5/1974 | Frankenberg et al. | 220/284 |

*Primary Examiner*—George T. Hall

*Attorney, Agent, or Firm*—Lowe, Kokjer, Kircher, Wharton & Bowman

[57] ABSTRACT

A tool which is used to remove lids that are sealed on large plastic shipping containers. The tool includes an elongate handle and an integral head portion from which a pair of spaced apart pegs project. The container wall is provided with a pair of security rings between which one of the pegs is received. The other peg fits between the upper security ring and a locking flange formed on the periphery of the lid. When the tool is rotated, the first peg bears against the lower security ring and serves as a fulcrum about which the other peg swings in a manner to pry the lid upwardly off of the container.

10 Claims, 6 Drawing Figures

LID LIFTING TOOL FOR SHIPPING CONTAINERS

BACKGROUND AND SUMMARY OF THE INVENTION

This invention relates to a uniquely constructed shipping container and to a tool which is used to remove the lid therefrom.

At present, it is a difficult and time consuming task to open large plastic shipping containers, primarily because their lids are firmly sealed in place for security reasons. To discourage theft of the contents, the closure arrangement for the container should be such that it cannot be opened easily with conventional tools. Further, standard metal tools can mar and otherwise damage the container and lid.

The present invention is aimed at providing a secure and effective closure arrangement for large plastic shipping pails, together with a tool which allows the lid to be quickly and easily removed when the container has reached its destination. In accordance with the invention, the container lid has a peripheral locking structure which seals with the top rim of the container. The container wall is usually provided with a pair of security rings which restrict access to the locking structure, thereby discouraging accidental opening during shipment. A tool which accompanies the container is specially constructed to permit removal of the lid in a quick and efficient manner when the container is to be unloaded.

It is an object of the present invention to provide a tool which may be used to quickly and easily remove the lids from large shipping containers.

Another object of the invention is to provide a tool which is constructed to cooperate with the container structure in a manner to make effective use of leverage, thus minimizing the effort required to remove the lid.

Yet another object of the invention is to provide a tool of the character described which avoids marring or otherwise damaging the container.

A further object of the invention is to provide a tool of the character described which is constructed so as not to slip on the container or lid during use.

A still further object of the invention is to provide a tool of the character described which is adapted to be attached to the container during transport in order to be readily available for use when needed.

Other and further objects of the invention, together with the features of novelty appurtenant thereto, will appear in the course of the following description.

DETAILED DESCRIPTION OF THE INVENTION

In the accompanying drawing which forms a part of the specification and is to be read in conjunction therewith and in which like reference numerals are used to indicate like parts in the various views.

Figure 1:
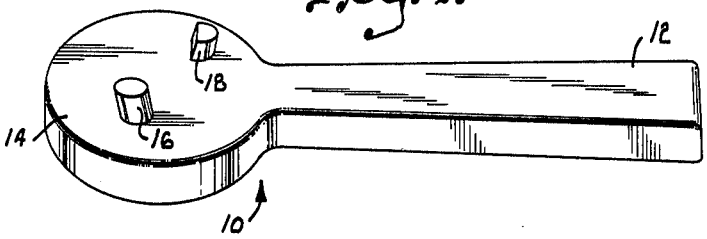
FIG. 1 is a perspective view of a lid lifting tool constructed according to a preferred embodiment of the invention.

With reference now to the drawings in more detail, FIG. 1 illustrates a lid lifting tool 10 constructed in accordance with the invention. Preferably, the tool is formed of a hard plastic material and is molded in a single piece. The tool 10 includes an elongate handle which is sized to fit conveniently in the hand. Integral with one end of handle 12 is an enlarged, generally circular head portion 14. The handle 12 and head portion 14 have flat opposite sides.

A pair of spaced apart pegs 16 and 18 project outwardly from one flat surface of the head portion 14. The pegs are generally cylindrical members located on opposite sides of the longitudinal center line of the tool and also on opposite sides of the diameter line extending transversely across head 14. The pegs are substantially equidistant from the center of the head portion of the tool. The side of peg 18 facing away from handle 12 is flattened, as is the outer end of each peg.

Pegs 16 and 18 are oriented to take full advantage of leverage and to prevent the tool from slipping during use. Peg 16 angles slightly away from handle 12 and also slightly toward the near edge of head 14 as it extends outwardly. Peg 18 is angled in a substantially opposite direction as it extends outwardly, i.e., generally toward handle 12 and the near edge of the head portion. The axis of each peg is thus located in a plane passing through each peg and perpendicular to the surface of head 14, with the pegs diverging as they extend outwardly.

Figure 2:
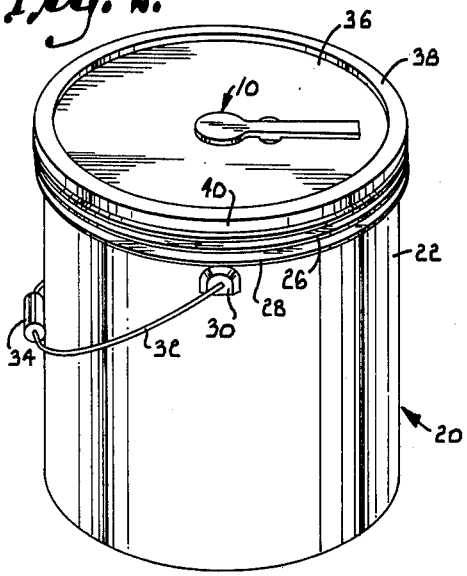
FIG. 2 is a perspective view of a large plastic shipping container which is covered by a sealed lid, with the tool being shown in its stored position on the lid.
Figure 3:
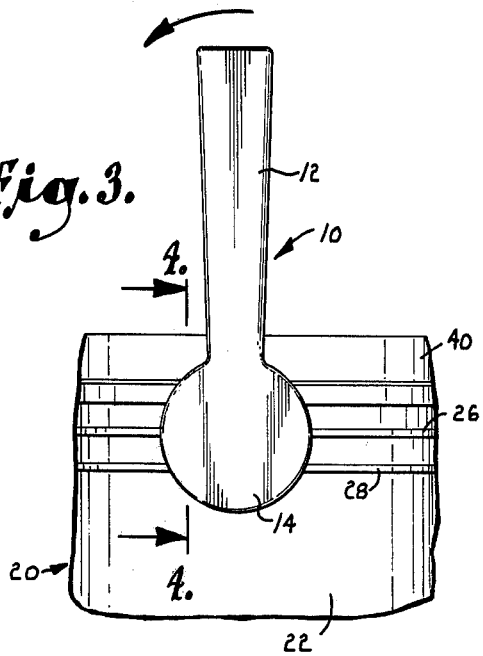
FIG. 3 is a fragmentary elevational view showing the tool applied to the shipping container in position to remove the lid.
Figure 4:
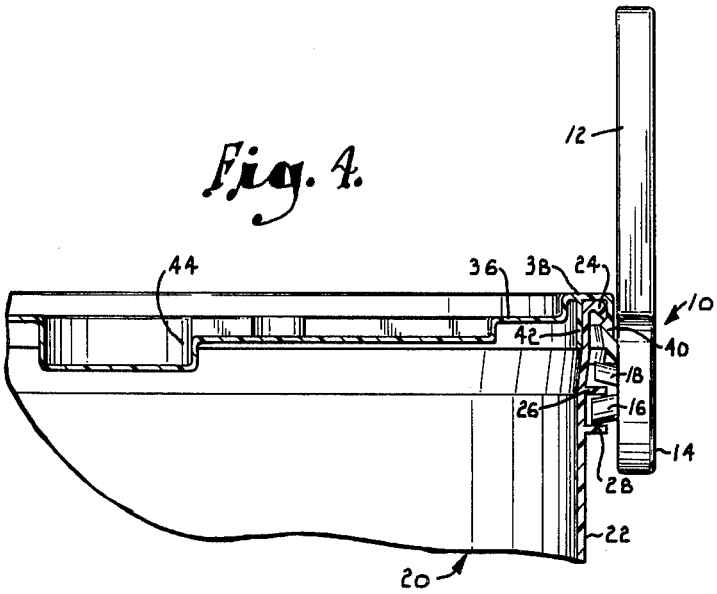
FIG. 4 is a fragmentary sectional view taken through the container generally along line 4—4 of FIG. 3 in the direction of the arrows.

The tool 10 may be used to remove the lid from a large plastic shipping container of pail which is constructed according to the invention and which is generally designated by numeral 20 in FIGS. 2–4. The pail 20 has a solid bottom (not shown) and a cylindrical wall 22 which terminates at its upper edge in an outwardly projecting rim 24 (FIG. 4). The rim 24 is thickened somewhat and tapers to a downwardly pointing lip at its lower edge. Upper and lower security rings 26 and 28 are formed to extend around the exterior surface of wall 22. The rings 26 and 28 are spaced apart from one another and are located well below the rim 24. The flat upper surface of the lower security ring 28 provides an upwardly facing shoulder for a purpose that will become clear.

Located at diametrically opposed portions on the wall 22 and below the lower security ring 28 are a pair of bail bearings 30, only one of which is visible in FIG. 2. These bearings 30 receive the opposite ends of a wire bail 32 having a central handle 34 by which the pail may be carried.

A lid 36 is sealed over the top end of pail 20 to enclose the contents during shipping. The lid is a generally flat, circular member having a raised surface 38 extending around its periphery. A peripheral flange 40 projects downwardly from the outer edge of surface 38. As shown in FIG. 4, the flange 40 has a thickened lower portion which is engaged beneath the lip of rim 24 when the lid is in place on top of the pail. The lower edge of flange 40 is spaced above the upper security ring 26. A flat ring 42 extends downwardly from the underside of surface 38 at a location to lie flatly against the upper interior portion of the pail wall 22. The spacing between flange 40 and ring 42 is such that rim 24 is tightly held between them to provide a tight seal of the lid on the pail. The resilient nature of flange 40 maintains its thickened portion firmly engaged beneath rim 24, although the flange may be displaced outwardly to release the rim.

During transport of the shipping pail, tool 10 is preferably carried in an appropriately shaped recess 44 formed in lid 36. The recess is sized to firmly retain the tool and is deep enough that the stored tool will not interfere with stacking of pails on top of one another.

In use, the tool is removed from recess 44 and is applied to the pail as shown in FIGS. 3 and 4. With handle 12 oriented vertically, peg 16 is inserted between the security rings 26 and 28, while peg 18 is inserted between the upper ring 26 and the lower edge of flange 40. The tool is then turned by its handle in the direction indicated by the arrow in FIG. 3. This action causes the tool to swing about the fulcrum provided by peg 16, which bears downwardly against the shoulder presented by the upper surface of ring 28. Peg 18 swings about the axis of peg 16 and is thereby raised against the underedge of flange 40 in order to apply a lifting force which pries the flange upwardly and disengages its thickened portion from rim 24. After the seal has thus been broken, the tool is moved partially around the container and employed in the same fashion to lift another portion of the lid. In this manner, the lid is eventually removed from the pail.

It is important for the pegs 16 and 18 to be spaced apart since they are disposed on opposite sides of ring 26 when used with pails of the type illustrated in the drawing. It is to be understood, however, that the tool may be used with other types of containers and other types of lids.

The angled orientation of pegs 16 and 18 with respect to the face of the tool is important in achieving good leverage and preventing the tool from slipping. Since the pegs diverge along the line extending between them, peg 16 inclines downwardly and toward one side (the left side as viewed in FIG. 3) while peg 18 extends upwardly and toward the other side. Consequently, peg 16 is able to resist the forces tending to slide it along ring 28 as the lid is being lifted by peg 18. At the same time, the downward angle of peg 16 and the upward angle of peg 18 beneath flange 40 (see FIG. 4) prevents the tool from inadvertently releasing from the pail.

Figure 5:
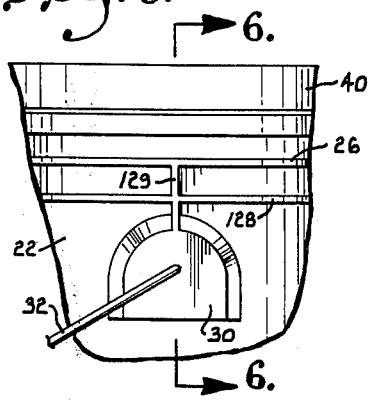
FIG. 5 is a fragmentary elevational view illustrating a modification of the security ring structure for the shipping container.
Figure 6:
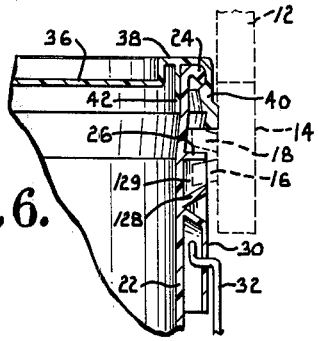
FIG. 6 is a fragmentary sectional view taken generally along line 6—6 of FIG. 5 in the direction of the arrows, with a portion of the lid lifting tool shown in broken lines applied to the container.

FIGS. 5 and 6 illustrate a slightly modified form of the shipping pail. For the most part, the shipping pail of FIGS. 5 and 6 is constructed identically to that shown in FIGS. 2–4, and identical reference numerals are employed. The major change is in the lower security ring which is indicated at 128 in FIGS. 5 and 6.

The ring 128 is inclined upwardly as it extends outwardly from the container wall. Consequently, its flat upper surface presents an upwardly inclined shoulder against which peg 16 bears during rotation of the tool. This upward inclination of ring 128 not only increases its strength but also provides an improved surface which lessens the tendency of peg 16 to slip.

For strengthening purposes, the container wall is provided with a short vertical rib 129 which extends between the two security rings 26 and 128. The lower end of rib 129 terminates at the bail bearing 30. There are preferably a number of ribs 129 spaced around the container wall.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawing is to be interpreted as illustrative and not in a limiting sense.

Having thus described the invention, I claim:

1. A tool for use in removing the lid which is tightly fit on top of a container presenting an upwardly facing shoulder spaced below the periphery of the lid, said tool comprising:

an elongate handle adapted for manual grasping;

a first peg projecting outwardly from said handle, said first peg being adapted to be applied to said shoulder and to bear thereagainst in a manner providing a fulcrum about which said handle may be turned; and a second peg projecting outwardly from said handle at a location spaced apart from said first peg, said second peg being adapted to be applied to the periphery of said lid and to act upwardly thereon in prying fashion in response to turning of said handle about the fulcrum provided by said first peg, whereby said second peg applies a lifting force acting to pry said lid off of the top of the container as said handle is turned about said second peg.

2. A tool as set forth in claim 1, wherein said first and second pegs diverge as they extend away from said handle.

3. A tool as set forth in claim 1, wherein said first peg is oriented to angle away from said handle in a generally downwardly inclined direction when applied to said shoulder; and said second peg is oriented to angle away from said handle in a generally upwardly inclined direction when applied to the periphery of said lid.

4. A tool as set forth in claim 1, wherein:

said first peg is oriented to angle away from said handle in a generally downwardly and sidewardly direction when applied to said shoulder; and said second peg is oriented to angle away from said handle in a generally upwardly and sidewardly direction when applied to the periphery of said lid.

5. A tool as set forth in claim 1, wherein said shoulder is presented on a first ring member projecting outwardly from the exterior of the container.

6. A tool as set forth in claim 5, wherein said container includes a second outwardly projecting ring member located between said first ring member and the periphery of said lid, said first peg being adapted to fit between said first and second ring members and said second peg being adapted to fit between said second ring member and the periphery of said lid when the tool is applied to the container.

7. In combination with a container having a top end covered by a lid and a pair of ring members extending substantially around the container at spaced apart locations below said lid, a tool for lifting the lid comprising:

an elongate handle adapted for manual grasping;

a first peg projecting outwardly from said handle, said first peg being adapted to be applied to one of said ring members and to bear thereagainst in a manner providing a fulcrum about which said handle may be turned; and a second peg projecting outwardly from said handle, said second peg being adapted to be applied to the periphery of said lid and to act upwardly thereon in prying fashion in response to turning of said handle about the fulcrum provided by said first peg, whereby said second peg applies a lifting force acting to pry said lid off of the top of the container as said handle is turned about said second peg.

8. The invention set forth in claim 7, wherein said one ring member is inclined upwardly as it extends away from the container to thereby present an upwardly inclined surface for engagement with said first peg.

9. The invention set forth in claim 8, including a rib extending along the exterior surface of said container substantially between said ring members.

10. The invention set forth in claim 7, wherein said first and second pegs are spaced apart from one another, said first peg being adapted to fit between said ring members and said second peg being adapted to fit between the upper ring members and the periphery of said lid when the tool is applied to the container.

* * * * *